US006826860B2

(12) United States Patent
Ko et al.

(10) Patent No.: US 6,826,860 B2
(45) Date of Patent: Dec. 7, 2004

(54) PORTABLE WORDSIGN ARRANGEMENT

(76) Inventors: Yu-Chow Ko, Unit B, 19/F, Skylodge 1 Dynasty Heights, 8 Yin Ping Road, Kowloon H.K., P.R. (CN); Yong Qiang Liu, 2-7680 Gilbert Road, Richmond, B.C. (CA), V7C 2W2

( * ) Notice: Subject to any disclaimer, the term of this patent is extended or adjusted under 35 U.S.C. 154(b) by 0 days.

(21) Appl. No.: 10/315,260

(22) Filed: Dec. 10, 2002

(65) Prior Publication Data

US 2004/0107616 A1 Jun. 10, 2004

(51) Int. Cl.[7] ..... G09F 13/00
(52) U.S. Cl. ..... 40/552
(58) Field of Search ..... 40/550, 551, 552; 362/812

(56) References Cited

U.S. PATENT DOCUMENTS 5,075,992 A * 12/1991 Kahn ..... 40/406
6,131,322 A * 10/2000 Hjaltason ..... 40/615
6,205,691 B1 * 3/2001 Urda et al. ..... 40/559

* cited by examiner

*Primary Examiner*—S. Joseph Morano
*Assistant Examiner*—Robert J. McCarry, Jr.
(74) *Attorney, Agent, or Firm*—Raymond Y. Chan; David and Raymond Patent Group

(57) ABSTRACT

A portable wordsign arrangement includes a wordsign supporter, a power supply supported by the wordsign supporter, a word character arrangement, which is formed by a plurality of illuminating characters, comprising at least a rope light having an electric connector end electrically connected to the power supply, wherein the rope light is shaped into the illuminating characters for increasing a visibility of the word character arrangement at a low light condition, and a plurality of mounting elements securely mounting the illuminating characters of the word character arrangement on the wordsign supporter. Therefore, the word character arrangement enables the user to customize each of the illuminating characters via the rope light to form as an indication sign.

23 Claims, 9 Drawing Sheets

PORTABLE WORDSIGN ARRANGEMENT

BACKGROUND OF THE PRESENT INVENTION

1. Field of Invention

The present invention relates to a rope light, and more particularly to a portable wordsign arrangement which enables the user to customize the array of alphabet and/or number units to form an individual wordsign for increasing the visibility in a low light condition.

2. Description of Related Arts

Nowadays, most decoration lighting and advertisement signs are fluorescent or neon lamps. The fluorescent lamp or the neon lamp not only gives the sharp image of the advertisement sign but also provides lots of fancy for decoration. Therefore, the sign of the street number or the indication sign such as the "OPEN" wordsign supporter of the restaurant is made by the fluorescent lamp or the neon lamp. However, such fluorescent or neon lamp has several drawbacks.

Since each of the wordsign supporters has different arrays of alphabet or the number, each wordsign supporter must be custom made. For example, each user must custom made the wordsign supporter for his or her street number sign. Therefore, the manufacturing cost of the wordsign supporter will be highly increased. Thus, since the arrays of the alphabet and/or the number are linked with each other, when one of the alphabet or the number is broken, which is not replaceable, the entire wordsign supporter must be replaced.

In addition, the manufacturing process of making the wordsign supporter is complicated. The conventional method of making the fluorescent lamp for the wordsign supporter comprises the steps of constructing the glass tube to form the alphabet or the number and adhering the fluorescent powder on the inner surface of the glass tube to tint the color on the glass tube. Therefore, the conventional method has many limitations according to the shape and size of the wordsign supporter. Moreover, since only one single colored fluorescent powder can be adhered on the inner surface of the glass tube, it is too tedious that one single color formed on the glass tube of the fluorescent lamp.

SUMMARY OF THE PRESENT INVENTION

A main object of the present invention is to provide a portable wordsign arrangement, which enables the user to customize the array of alphabet and/or number units to form an individual wordsign for increasing the visibility in a low light condition.

Another object of the present invention is to provide a portable wordsign arrangement, which is capable of functioning as a sign or the street number of street name, an individual door sign, or an advertisement sign.

Another object of the present invention is to provide a portable wordsign arrangement, wherein each of the illuminating characters is formed by the rope light in such a manner that the user is able to customize the array of the illuminating character according to the needs of the user.

Another object of the present invention is to provide a portable wordsign arrangement, wherein each of the illuminating characters is replaceable so that the user is able to change the non-functional illuminating character instead of replacing the entire wordsign arrangement.

Another object of the present invention is to provide a portable wordsign arrangement, wherein the installation of the illuminating character is simple and easy that by attaching the rope light on the wordsign supporter. Therefore, every individual is able to build his or her own wordsign arrangement by characterizing the rope light to form the illuminating character and mounting the illuminating character on the wordsign supporter.

Another object of the present invention is to provide a portable wordsign arrangement, wherein no expensive or complicated structure is required to employ in the present invention in order to achieve the above mentioned objects. Therefore, the present invention successfully provides an economic and efficient solution for not only providing an illuminating configuration of the wordsign supporter but also enhancing the appearance and visibility of the wordsign.

Accordingly, in order to accomplish the above objects, the present invention provides a portable wordsign arrangement, comprising:

a wordsign supporter;

a power supply supported by the wordsign supporter;

a word character arrangement, which is formed by a plurality of illuminating characters, comprising at least a rope light having an electric connector end electrically connected to the power supply, wherein the rope light is shaped into the illuminating characters for increasing a visibility of the word character arrangement at a low light condition; and means for securely mounting the word character arrangement on the wordsign supporter.

According to the above embodiment, the illuminating characters are shaped as alphabets, A to Z, and numbers, 0 to 9.

Still other advantages of the present invention will become readily apparent to those skilled in this art from the following detail description, wherein the present invention has merely shown and described in the preferred embodiment, simply by way of illustration of the best mode of carrying out the present invention. As will be realized, the present invention is capable of other and different embodiments, and its several details are capable of modifications in various obvious respects, all without departing from the invention. Accordingly, the drawings and description are to be regarded as illustrative in nature, and not as restrictive.

These and other objectives, features, and advantages of the present invention will become apparent from the following detailed description, the accompanying drawings, and the appended claims.

DETAILED DESCRIPTION OF THE PREFERRED EMBODIMENT

Figure 1:
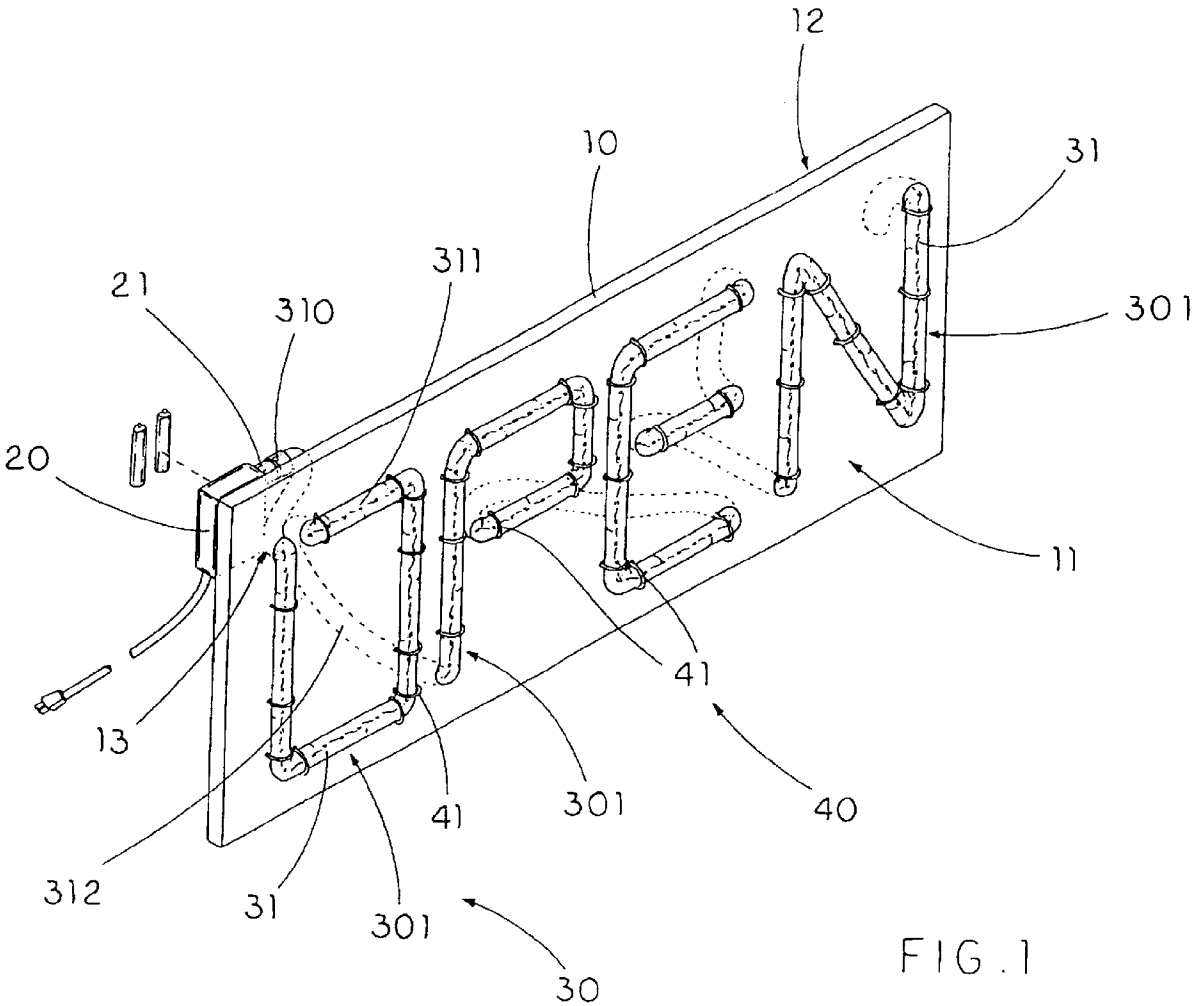
FIG. 1 is a perspective view of a portable wordsign arrangement according to a first preferred embodiment of the present invention.

Referring to FIG. 1 of the drawings, a portable wordsign arrangement according to a first preferred embodiment of the present invention is illustrated, wherein the portable wordsign arrangement comprises a wordsign supporter 10 and a power supply 20 supported by the wordsign supporter 10.

The portable wordsign arrangement further comprises a word character arrangement 30, which is formed by a plurality of illuminating characters 301, comprising at least a rope light 31 having an electric connector end 310 electrically connected to the power supply 20, wherein the rope light 31 is shaped into the illuminating characters 301 for increasing a visibility of the word character arrangement 30 at a low light condition, and means 40 for securely mounting the word character arrangement 30 on the wordsign supporter 10.

Figure 2:
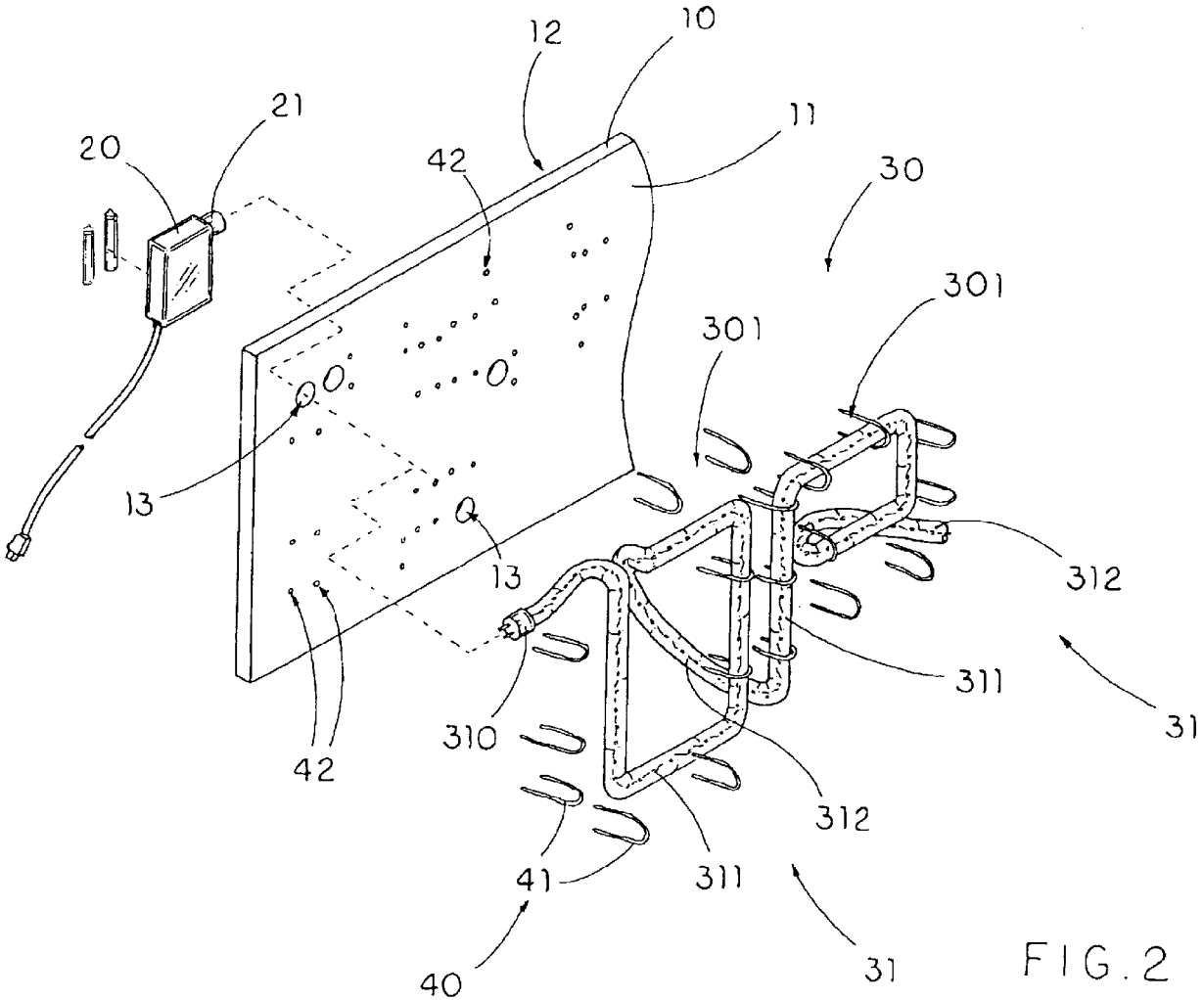
FIG. 2 is a partially exploded perspective view of the portable wordsign arrangement according to the above first preferred embodiment of the present invention.

According to the preferred embodiment, the wordsign supporter 10, which is embodied as a signboard, has a front side 11, a rear side 12, and at least a rope outlet 13 formed on the wordsign supporter 10 to communicate the front side 11 of the wordsign supporter 10 with the rear side 12 thereof wherein the rope light 31 is adapted to slidably pass from the front side 11 of the wordsign supporter 10 to the rear side 12 thereof through the rope outlet 13, as shown in FIG. 2.

The power supply 20 is preferred to be mounted on the rear side 12 of the wordsign supporter 10 in such a manner that when the rope light 31 is mounted on the front side 11 of the wordsign supporter 10, the electric connecter end 310 of the rope light 31 is extended to the rear side 12 of the wordsign supporter 10 through the rope outlet 13 to electrically connect to the power supply 20. Accordingly, the power supply 20 comprises a power socket 21 electrically extended from an AC power source to electrically connect to the electric connecter end 310 of the rope light 31. Alternatively, the power supply 20 can be embodied as a battery housing for receiving a replaceable battery as a power source to electrically connect to the rope light 31. In other words, the wordsign arrangement of the present invention is capable of using both AC and DC power to enhance the portability of the present invention.

The word character arrangement 30 are formed by bending the rope light 31 into each of the illuminating characters 301 in such a manner that the illuminating characters 301 are electrically connected with each other through the rope light 31. Accordingly, the illuminating characters 301 are shaped as alphabets, A to Z, and numbers, 0 to 9.

The rope light 31 has a character shaping portion 311 bent to form the respective illuminating character 30 and an extension portion 312 extended between each two illuminating characters 301 such that the illuminating characters 301 are integrally linked by the rope light 31, wherein the character shaping portion 311 of the rope light 31 is mounted on the front side 11 of the wordsign supporter 10 via the mounting means 40 and the extension portion 312 of the rope light 31 is slidably extended to the rear side 12 of the wordsign supporter 10 through the respective rope outlet 13, as shown in FIG. 1.

In other words, the user is able to customize each of the illuminating characters 301 by using the character shaping portion 311 of the rope light 31 on the front side 11 of the wordsign supporter 10 while the extension portion 312 of the rope light 31 is hidden behind the wordsign supporter 10.

Figure 3:
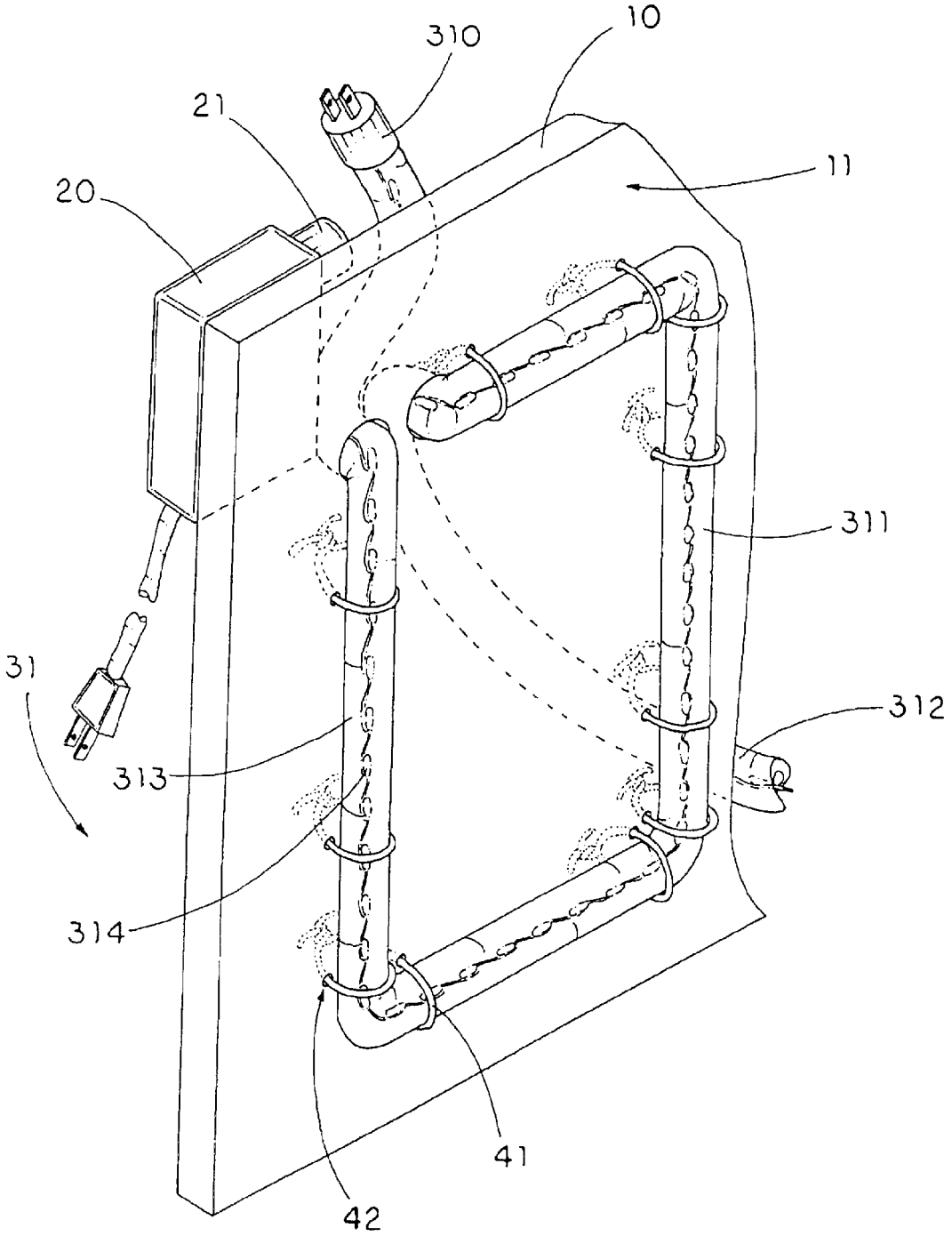
FIG. 3 is a perspective view of the rope light of the illuminating character of the portable wordsign arrangement according to the above first preferred embodiment of the present invention.

As shown in FIG. 3, the rope light 31, such as a flexilight, is constructed by a flexible tubular shelter 313 and at least an illuminating element 314, such as a LED, disposed in the tubular shelter 313 in such a manner that when the illuminating element 314 is electrically connected to the power supply 20, the illuminating element 314 generates a light passing through the tubular shelter 313 to outside. Accordingly, the tubular shelter 313 is a PVC coating such that the illuminating element 314 is protected in the tubular shelter 313 so as to ensure the electric connection of the illuminating element 314. In addition, the illuminating arrangement of the rope light 31 can be either the horizontal bulb or the vertical bulb wherein the illuminating element 314 is electrically connected to the electric connecter end 310 of the rope light 31 through a tin-wire.

It is worth to mention that since the extension portion 312 of the rope light 31 is positioned behind the wordsign supporter 10 at the rear side 12 thereof, the light from the extension portion 312 of the rope light 31 is blocked by the wordsign supporter 10, so that only the character shaping portion 311 of the rope light 31 indicates the illuminating character 301 of the word character arrangement 30.

The mounting means 40 comprises a plurality of mounting elements 41 spacedly and detachably attached to the wordsign supporter 10 to retain the character shaping portion 311 of the rope light 31 on the front side 11 of the wordsign supporter 10. According to the preferred embodiment, the mounting elements 41 are mounting clips and the mounting means 40 further has a plurality of mounting holes 42 formed on the wordsign supporter 10 from the front side 11 to rear side 12 and wherein each of the mounting elements 41 has two ends slidably passing through the two respective mounting holes 42 and locked at the rear side 12 of the wordsign supporter 10 so as to securely mount the rope light 31 on the wordsign supporter 10.

In order to use the present invention, the user must use the rope light 31 to shape each of the illuminating characters 301 in such a manner that the illuminating characters 301 are electrically connected with each other through the rope light 31. Then, the user is able to mount the character shaping portion 311 of the rope light 31 on the front side 11 of the wordsign supporter 10 via the mounting elements 41, wherein the extension portion 312 of the rope light 31 is positioned at the rear side 12 of the wordsign supporter 10 through the rope outlet 13. Therefore, when the electric connector end 310 of the rope light 31 is electrically connected to the power supply 20, the illuminating element 314 of the rope light 31 generates the light to lighten the illuminating character so as to enhance the visibility of the word 30 at the low light condition. It is worth to mention that the rope light 31 is capable of providing different colors and/or light effect to enhance the appearance of the word character arrangement 30.

For example, when the illuminating characters 301 of the word character arrangement 30 are embodied as "O", "P", "E", and "N", respectively, the user is able to shape the character shaping portions 311 of the rope light 31 to form the "O", "P", "E", and "N" shapes of the illuminating characters 301 in a continuous manner and mount the illuminating characters 301 on the front side 11 of the wordsign supporter 10 via the mounting means 40 while each extension portion 312 of rope light 31 between each two illuminating characters 301 is extended on the rear side 12 of the wordsign supporter 10.

Figure 4:
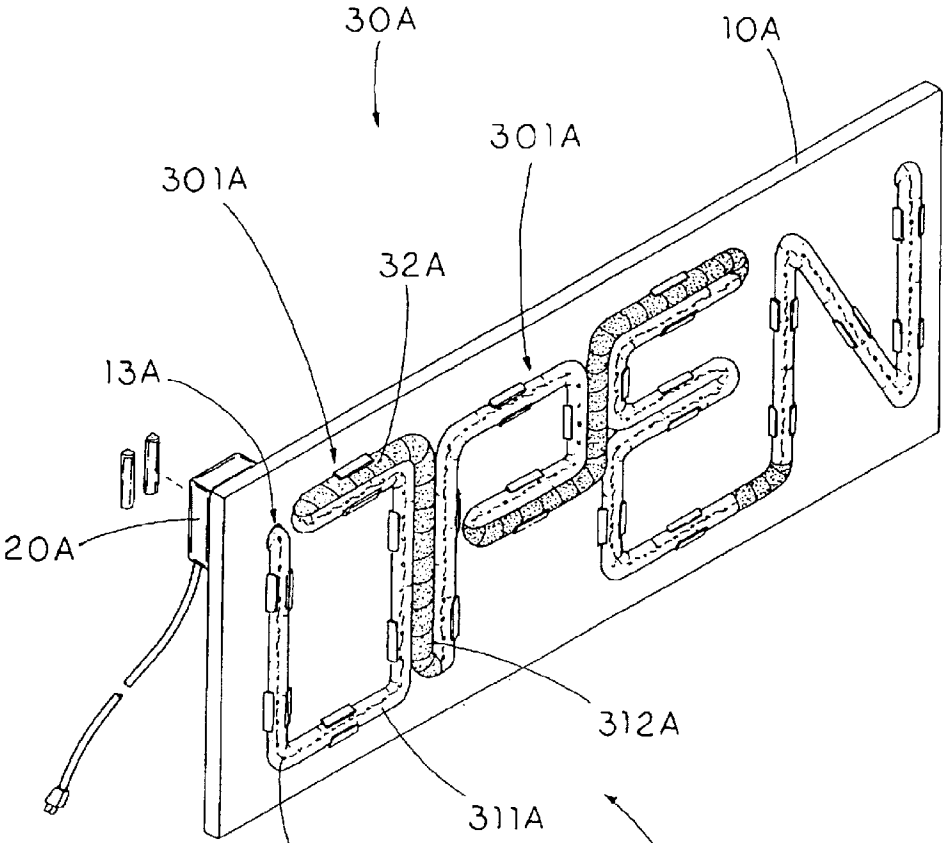
FIG. 4 illustrates an alternative mode of the illuminating character of the portable wordsign arrangement according to the above first preferred embodiment of the present invention.

FIG. 4 illustrates an alternative mode of the configuration of the rope light 31A wherein the rope light 31A is shaped to form the illuminating characters 301A of the word character arrangement 30A. The rope light 31A has a character shaping portion 311A bent to form the respective illuminating character 301A and an extension portion 312A extended between each two illuminating characters 301A wherein the rope light 31A is securely mounted on the front side 11A of the wordsign supporter 10A via the mounting means 40A.

As shown in FIG. 4, the word character arrangement 30A further comprises a light blocking element 32A affixed to the extension portion 312A of the rope light 30A for blocking the light from the illuminating element 314A to outside such that when the rope light 31A is mounted on the front side 11A of the wordsign supporter 10A, only the character shaping portion 311A of the rope light 31A generates light to outside to indicate the respective illuminating character 301A. In other words, the wordsign supporter 10A only requires one rope outlet 13A for the electric connector end 310A of the rope light 31A passing through.

Accordingly, the light blocking element 32A can be embodied as a black color paint coated on the extension portion 312A of the rope light 31A or a non-transparent tape affixed thereto for blocking the light from the extension portion 312A of the rope light 31A passing to outside.

Figure 5:
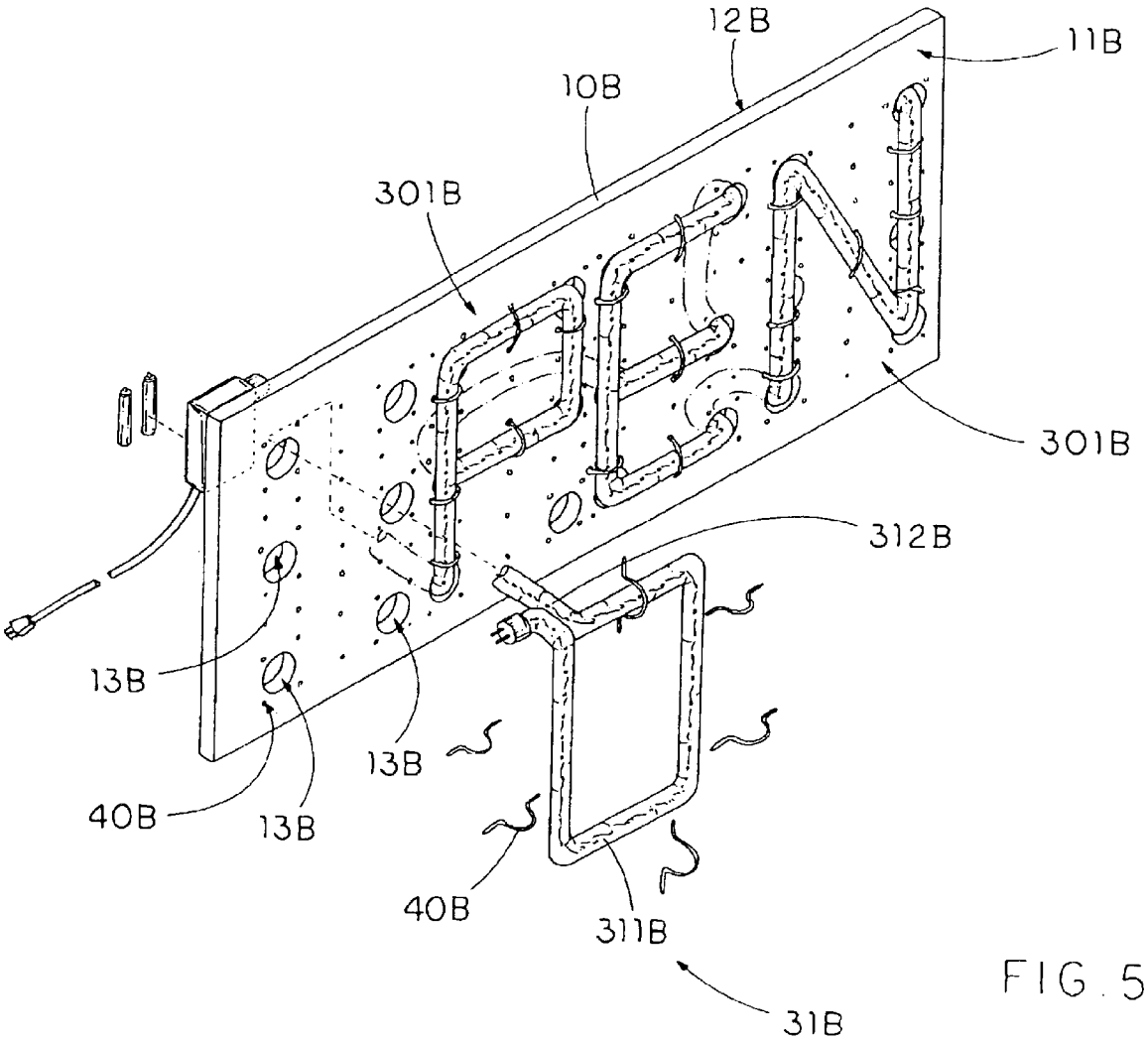
FIG. 5 illustrates an alternative mode of the wordsign supporter of the portable wordsign arrangement according to the above first preferred embodiment of the present invention.

FIG. 5 illustrates an alternative mode of the wordsign supporter 10B which is constructed as a universal wordsign supporter 10B for the user to customize the illuminating characters 301B. The wordsign supporter 10B has a plurality of rope outlets 13B formed thereon for each of the illuminating characters 301B in such a manner that the extension portion 312B of the rope light 31B is selectively extended to the rear side 12B of the wordsign supporter 10B through one of the rope outlets 13B while the character shaping portion 311B of the rope light 31B is mounted on the front side 11B of the wordsign supporter 10B via the mounting means 40B. In other words, the rope outlets 13B are pre-formed on the wordsign supporter 10B at predetermined locations so that the user is able to shape the rope light 31B into any illuminating character 301B on the wordsign supporter 10B.

Figure 6:
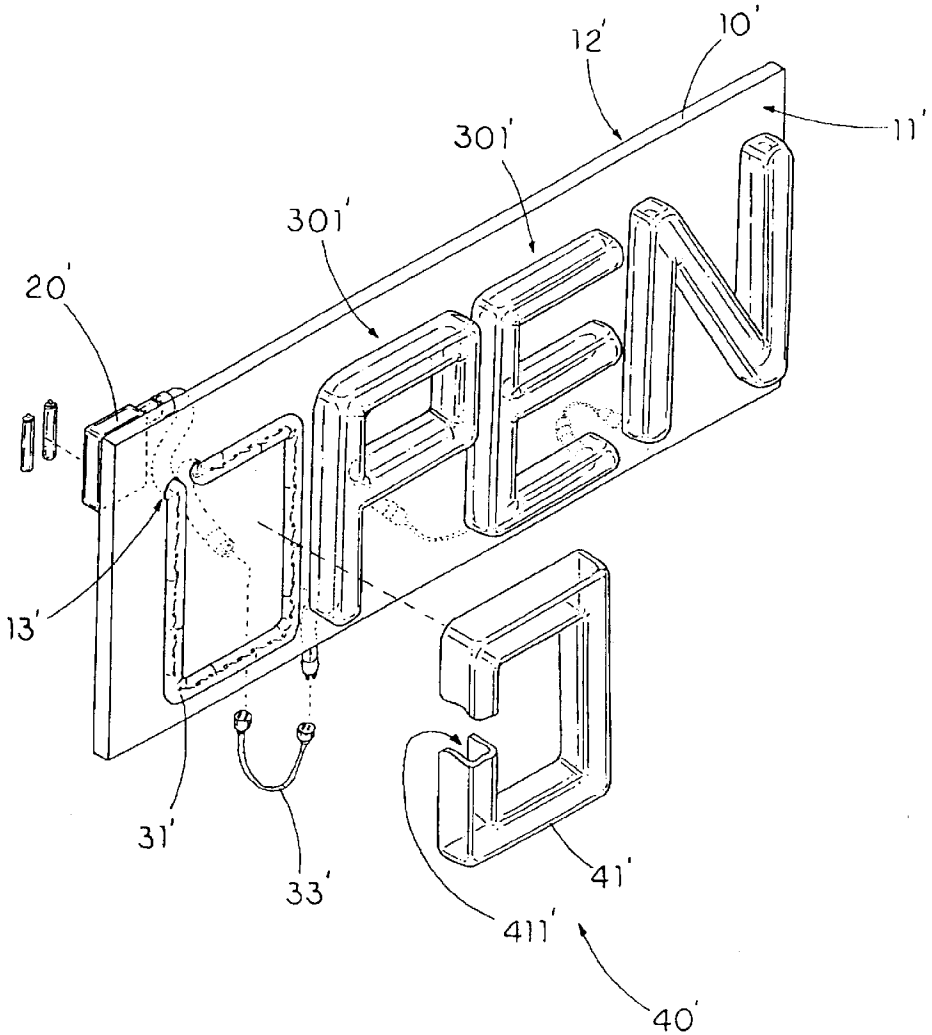
FIG. 6 is an exploded perspective view of a portable wordsign arrangement according to a second embodiment of the present invention.

As shown in FIG. 6, a portable wordsign arrangement of a second embodiment illustrates an alternative mode of the first embodiment of the present invention, wherein the word character arrangement 30' comprises a plurality of rope lights 31' shaped into the illuminating characters 301' respectively.

It is worth to mention that each of the illuminating characters 301' is formed by an individual rope light 31 ' to mount on the front side 11' of the wordsign supporter 10' such that no extension portion 312 of the rope light 31 is required to extend at the rear side 12' of the wordsign supporter 10'.

The word character arrangement 30' further comprises a rope light connecter 33' electrically connecting each two illuminating characters 301' in such a manner that the illuminating characters 301' are electrically connected to the power supply 20'. Therefore, the rope lights 31' are electrically connected with each other ends to ends via the rope light connecter 33'. As shown in FIG. 6, the wordsign supporter 10' has an outlet 13' formed thereon at a position of each of the illuminating character 301' such that the rope light connecter 33' is extended at the rear side 12' of the wordsign supporter 10' through the respective two outlets 13' to electrically connect between two illuminating characters 301'.

The mounting means 40', according to the second embodiment, comprises a plurality of character shelters 41' each having a character shape and a character chamber 411' wherein the rope lights 31' are respectively disposed in the character chambers 411' of the character shelters 41' so as to protect the illuminating characters 301'.

Accordingly, each of the character shelters 41' is mounted on the front side 11' of the wordsign supporter 10' wherein each of the character shelters 41' is constructed as a character cover to enclose the respective illuminating character 301' in the character chamber 411' when the character shelter 41' is sealedly mounted on the wordsign supporter 10'.

Figure 7:
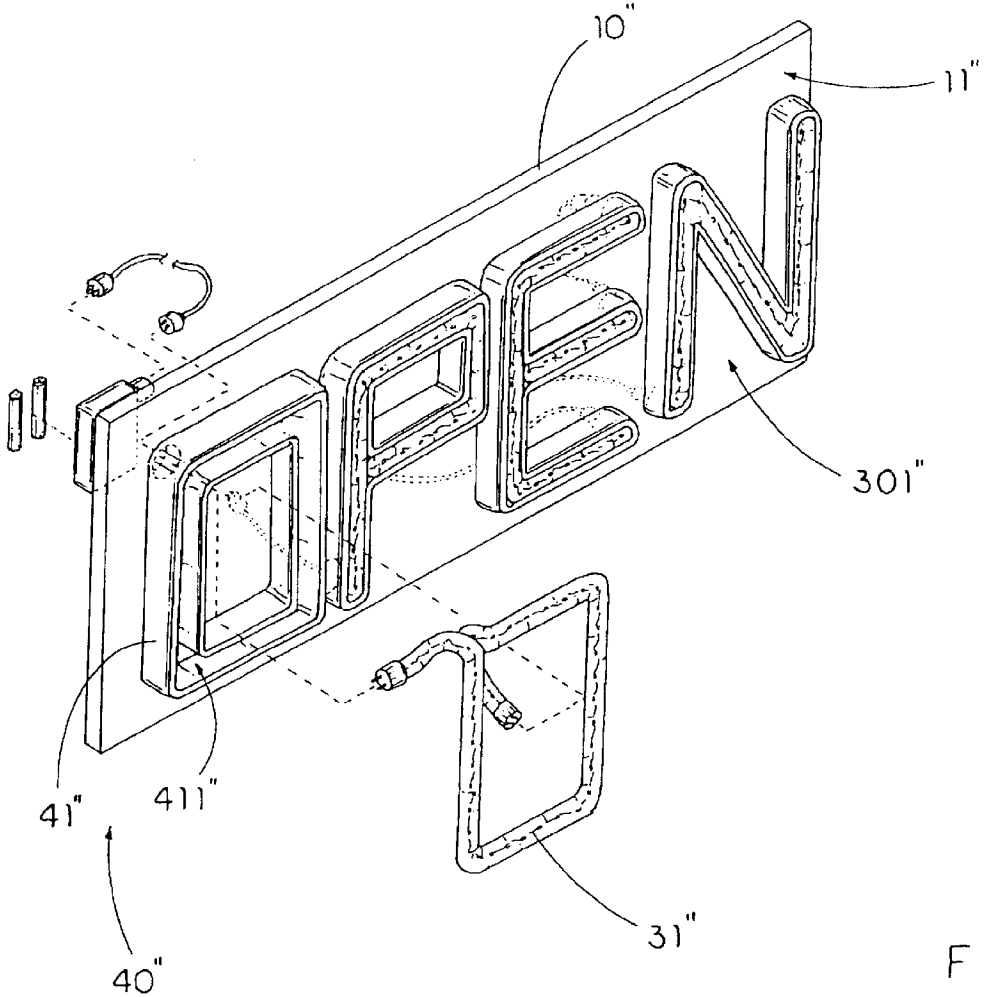
FIG. 7 illustrates an alternative mode of the character shelter of the portable wordsign arrangement according to the above second preferred embodiment of the present invention.

Alternatively, each of the character shelters 41" is protruded from the front side 11" of the wordsign supporter 10" wherein the character chamber 411" is embodied as a character channel formed on the wordsign supporter 10" in such a manner that the rope light 31" of the illuminating character 301" is disposed in the respective character chamber 411" so as to hold the illuminating character 301" on the wordsign supporter 10" in position, as shown in FIG. 7.

Figure 8:
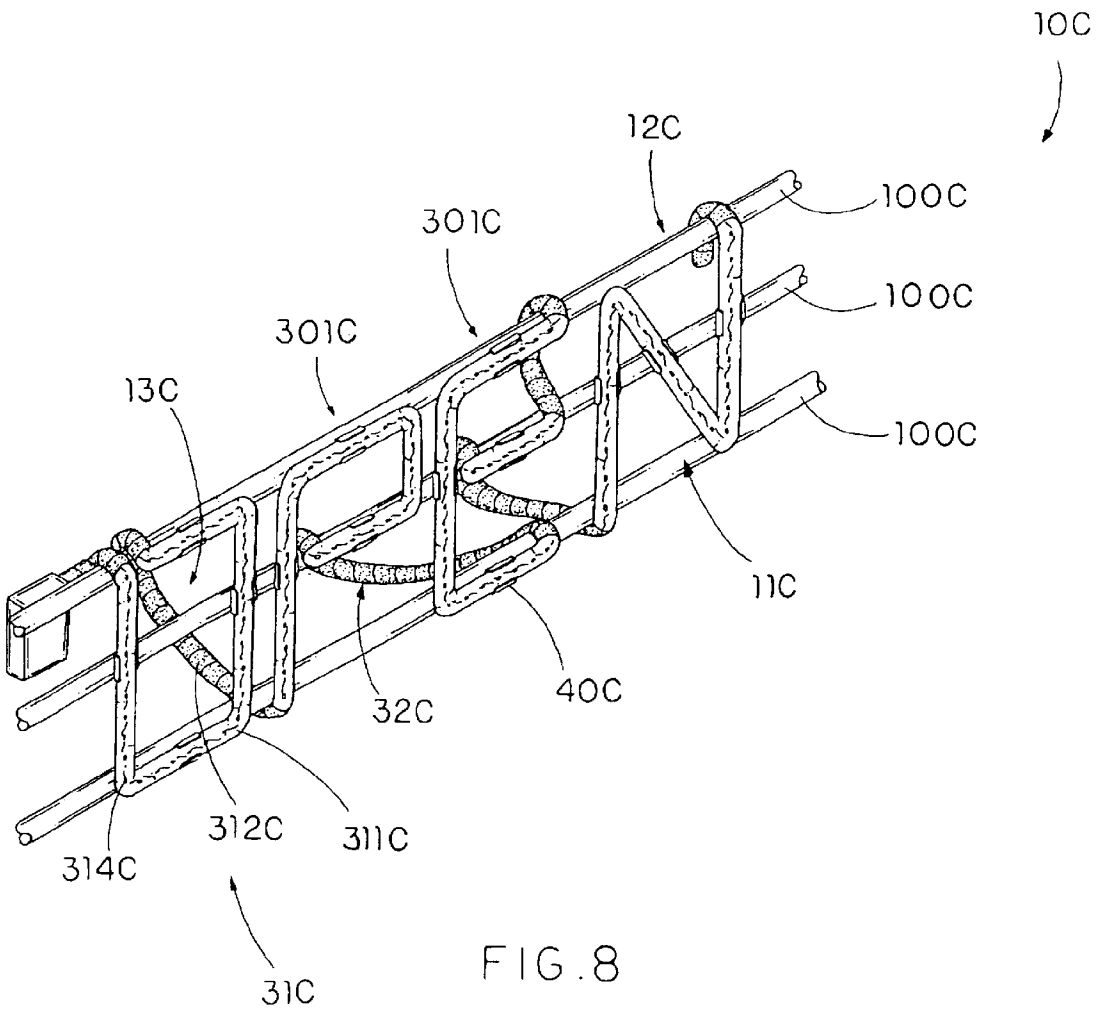
FIG. 8 illustrates an alternative mode of the wordsign supporter of the portable wordsign arrangement according to the above second preferred embodiment of the present invention.

As shown in FIG. 8, the wordsign supporter 10C is constructed by a plurality of supporting bars 100C spacedly extending wherein the rope outlet 13C is formed at a gap between the supporting bars 100C in such a manner that the rope light 31C is supported at the front sides 11 of the supporting bars 100C and extended to the rear sides 12 thereof through the rope outlet 13C.

Accordingly, the rope light 31C has a character shaping portion 311C bent to form the respective illuminating character 301C and an extension portion 312C extended between each two illuminating characters 301C wherein the rope light 31C is securely mounted on the front sides 11C of the supporting bars 100C of the wordsign supporter 10C via the mounting means 40C.

The word character arrangement 30C further comprises a light blocking element 32C affixed to the extension portion 312C of the rope light 30C for blocking the light from the illuminating element 314C to outside such that when the rope light 31C is mounted on the front side 11C of the wordsign supporter 10C, only the character shaping portion 311C of the rope light 31C generates light to outside to indicate the respective illuminating character 301C.

Figure 9A:
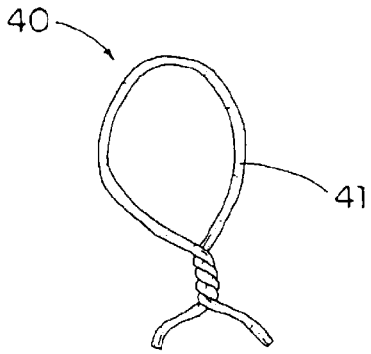
FIGS. 9A to 9E illustrate alternative modes of the mounting means of the portable wordsign arrangement according to the above first and second preferred embodiments of the present invention.

FIGS. 9A through 9E illustrates alternative modes of the mounting means 40. As shown in FIG. 9A, the mounting elements 41 are mounting wires each having two end portions extended to the rear side 12 of the wordsign supporter 10 through the mounting holes 42 respectively in such a manner that the rope light 31 is securely mounted on the wordsign supporter 10 by twisting the two end portions of the mounting wire of the mounting element 41 at the rear side 12 of the wordsign supporter 10, as shown in FIG. 3.

Figure 9B:
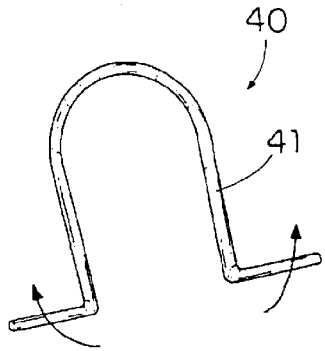

FIG. 9B illustrates that the mounting elements 41 are mounting clips each having two end portions extended to the rear side 12 of the wordsign supporter 10 through the mounting holes 42 respectively, in such a manner that the rope light is securely mounted on the wordsign supporter 10 by bending two end portions of the mounting clip of the mounting element 41 at the rear side 12 of the wordsign supporter 10, as shown in FIG. 5.

Figure 9C:
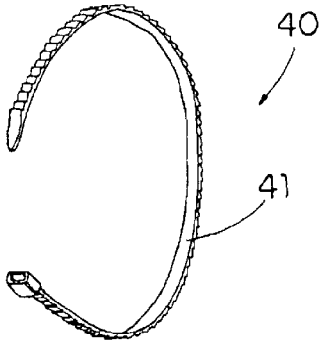

FIG. 9C illustrates that the mounting elements 41 are elongated zip lockers each having a locker head and an elongated zipper body arranged to slidably pass through the mounting holes 42 and locked by the locker head to form a zipper loop for securely mounting the rope light 31 on the wordsign supporter 10.

Figure 9D:
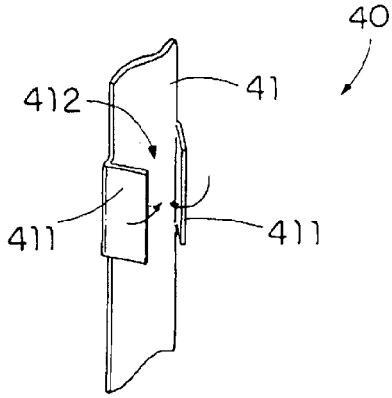

FIG. 9D illustrates that the mounting elements 41 are U-shaped elastic clips mounted on the wordsign supporter 10 wherein each elastic clip of the mounting elements 41 has two side walls 411 and a mounting channel 412 formed therebetween in such a manner that the rope light 31 is capable of mounting on the wordsign supporter 10 by receiving the rope light 31 in the mounting channel 412 while the side walls 411 are bent inwardly to hold the rope light 31 in the mounting channel 412, as shown in FIG. 4.

Figure 9E:
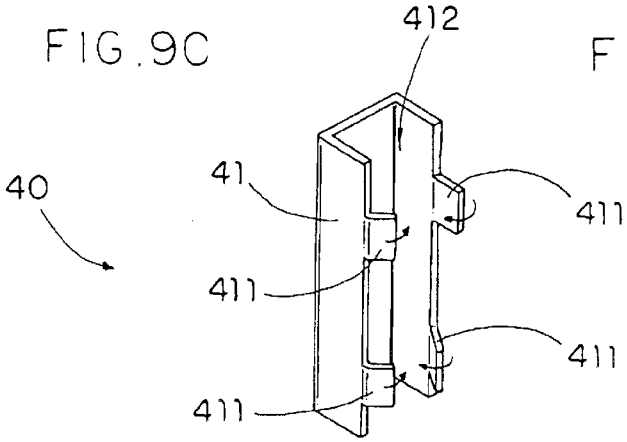

FIG. 9E illustrates that the mounting elements 41 are U-shaped mounting clips mounted on the wordsign supporter 10 wherein each mounting clip of the mounting elements 41 has a mounting channel 412 for receiving the rope light 31 therein and a plurality of elastic tips 411 spacedly extended from two outer edges of the mounting clip and arranged to be bent inwardly to securely hold the rope light 31 in the mounting channel 412.

In view of above, the illuminating characters of the word character arrangement are shaped by the rope light since the rope light having the flexible ability can be bent into any shape of the alphabets and numbers to increase the visibility of the word character arrangement at the low light condition. Since the rope light can provide different light effect while being cost effective, the user is able to easily customize the illuminating characters of the word character arrangement of the present invention as a sign of the street number or street name, an individual door sign, or an advertisement sign.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims. For example, the mounting means can be any attachment element adapted to securely mount the rope light on the wordsign supporter.

What is claimed is:

1. A portable wordsign arrangement, comprising:

a power supply;

a wordsign supporter having a front side and a rear side;

a word character arrangement electrically connected to said power supply and comprising:

one or more rope light made illuminating characters disposed on said front side of said wordsign supporter, and one or more extension portions extended between said illuminating characters and disposed on said rear side of said wordsign supporter; and means for mounting said illuminating characters on said front side of said wordsign supporter while said extension portions of said rope light are extended at said rear side of said wordsign supporter.

2. The portable wordsign arrangement, as recited in claim 1, wherein said illuminating characters and said extension portions are made from an elongated rope light which has one end electrically connected to said power supply, wherein said wordsign supporter has a plurality of rope outlets spacedly formed therein with respect to said illuminating characters, wherein said extension portions of said rope light are selectively extended to said rear side of said wordsign supporter through said rope outlets respectively.

3. The portable wordsign arrangement, as recited in claim 1, wherein each of said illuminating characters is made from an elongated rope light and comprises two rope light connecters at two ends thereof respectively, wherein said wordsign supporter has a plurality of rope outlets spacedly formed therein with respect to said illuminating characters and said rope light connecters of said illuminating characters are extended to said rear side of said wordsign supporter through said rope outlets, wherein said extension portions are electric cords connected said rope light connecters together respectively so as to electrically connecting illuminating characters with each other.

4. The portable wordsign arrangement, as recited in claim 2, wherein said mounting means has a plurality of mounting holes formed in said wordsign supporter and comprises a plurality of mounting elements spacedly and detachably attached to said wordsign supporter, wherein each of said mounting elements has two ends slidably passed through said mounting holes respectively and fastened on said wordsign supporter from behind so as to mount said illuminating characters on said wordsign supporter.

5. The portable wordsign arrangement, as recited in claim 3, wherein said mounting means has a plurality of mounting holes formed in said wordsign supporter and comprises a plurality of mounting elements spacedly and detachably attached to said wordsign supporter, wherein each of said mounting elements has two ends slidably passed through said mounting holes respectively and fastened on said wordsign supporter from behind so as to mount said illuminating characters on said wordsign supporter.

6. The portable wordsign arrangement, as recited in claim 2, wherein said mounting means comprises a plurality of character shelters mounted on said front side of said wordsign supporter, wherein each of said character shelters has a character shape and a character chamber and said illuminating characters are respectively disposed in said character chambers of said character shelters.

7. The portable wordsign arrangement, as recited in claim 3, wherein said mounting means comprises a plurality of character shelters mounted on said front side of said wordsign supporter, wherein each of said character shelters has a character shape and a character chamber and said illuminating characters are respectively disposed in said character chambers of said character shelters.

8. The portable wordsign arrangement, as recited in claim 6, wherein each of said character shelters, which is sealedly mounted on said front side of said wordsign supporter, is constructed as a character cover to enclose said respective illuminating character in said character chamber.

9. A portable wordsign arrangement, as recited in claim 7, wherein each of said character shelters, which is sealedly mounted on said front side of said wordsign supporter, is constructed as a character cover to enclose said respective illuminating character in said character chamber.

10. The portable wordsign arrangement, as recited in claim 6, wherein each of said character shelters is protruded from said front side of said wordsign supporter, wherein said character chamber is embodied as a character channel to receive said respective illuminating character therein so as to hold said illuminating characters on said wordsign supporter.

11. The portable wordsign arrangement, as recited in claim 7, wherein each of said character shelters is protruded from said front side of said wordsign supporter, wherein said character chamber is embodied as a character channel to receive said respective illuminating character therein so as to hold said illuminating characters on said wordsign supporter.

12. The portable wordsign arrangement, as recited in claim 2, wherein said mounting means comprises a plurality of U-shape elastic clips mounted on said front side of said wordsign supporter, wherein each of said elastic clips has two side walls to define a mounting channel therebetween, wherein said illuminating characters of said rope light are received in said mounting channels respectively and said side walls are bent inwardly to hold said rope light in said mounting channels respectively so as to securely mount said illuminating characters of said rope light on said front side of said wordsign supporter.

13. The portable wordsign arrangement, as recited in claim 3, wherein said mounting means comprises a plurality of U-shape elastic clips mounted on said front side of said wordsign supporter, wherein each of said elastic clips has two side walls to define a mounting channel therebetween, wherein said rope lights are received in said mounting channels respectively and said side walls are bent inwardly to hold said rope light in said mounting channels respectively so as to securely mount said illuminating characters on said front side of said wordsign supporters.

14. The portable wordsign arrangement, as recited in claim 2, wherein said mounting means comprises a plurality of U-shape mounting clips mounted on said wordsign supporter, wherein each of said mounting clips has a mounting channel to receive said respective illuminating character therein and a plurality of elastic tips spacedly extended from two outer edges of each of said mounting clips and arranged to be bent inwardly to securely hold said respectively illuminating character in said mounting channel.

15. The portable wordsign arrangement, as recited in claim 3, wherein said mounting means comprises a plurality of U-shape mounting clips mounted on said wordsign supporter, wherein each of said mounting clips has a mounting channel to receive said respective rope light therein and a plurality of elastic tips spacedly extended from two outer edges of each of said mounting clips and arranged to be bent inwardly to securely hold said respectively rope light in said mounting channel.

16. The portable wordsign arrangement, as recited in claim 1, wherein said illuminating characters are shaped as alphabets and numbers.

17. The portable wordsign arrangement, as recited in claim 2, wherein said rope light comprises a flexible tubular shelter and a plurality of LEDs spacedly disposed in said tubular shelter, wherein each of said LEDs generates light passing through said tubular shelter to outside when said LEDs are electrically connected to said power supply.

18. The portable wordsign arrangement, as recited in claim 3, wherein each of said rope lights comprises a flexible tubular shelter and a plurality of LEDs spacedly disposed in said tubular shelter in such a manner that when said LEDs are electrically connected to said power supply, each of said LEDs generates light passing through said tubular shelter to outside.

19. A portable wordsign arrangement, comprising:

a power supply;

a wordsign supporter;

a word character arrangement comprising an elongated rope light having one end connected to said power supply, wherein said rope light has a character shaping portion shaped into one or more illuminating characters mounted on said wordsign supporter and an extension portion having one or more segments extended between said illuminating characters, wherein said rope light comprises a flexible tubular shelter and a plurality of LEDs spacedly disposed in said tubular shelter and electrically connected to said power supply to generate light passing through said tubular shelter to outside; and means for mounting said word character arrangement on said wordsign supporter.

20. The portable wordsign arrangement, as recited in claim 19, wherein said word character arrangement further comprises a light blocking element provided along said extension portion of said rope light for blocking light projecting therefrom such that when said rope light is mounted on said wordsign supporter, only said character shaping portion of said rope light generates light to outside to show said illuminating characters.

21. The portable wordsign arrangement, as recited in claim 19, wherein said character shaping portion of said rope light is mounted on a front side of said wordsign supporter and said extension portion of said rope light is extended at a rear side of said wordsign supporter.

22. The portable wordsign arrangement, as recited in claim 20, wherein said character shaping portion of said rope light is mounted on a front side of said wordsign supporter while said extension portion of said rope light is extended at a rear side of said wordsign supporter.

23. The portable wordsign arrangement, as recited in claim 22, wherein said mounting means comprises a plurality of U-shape elastic clips mounted on said front side of said wordsign supporter, wherein each of said elastic clips has two side walls to define a mounting channel therebetween, wherein said rope lights are received in said mounting channels respectively and said side walls are bent inwardly to hold said rope light in said mounting channels respectively so as to securely mount said illuminating characters on said front side of said wordsign supporter.

* * * * *